US007002528B2

(12) United States Patent
Moheb

(10) Patent No.: US 7,002,528 B2
(45) Date of Patent: Feb. 21, 2006

(54) CIRCULARLY POLARIZED RECEIVE/TRANSMIT ELLIPTIC FEED HORN ASSEMBLY FOR SATELLITE COMMUNICATIONS

(75) Inventor: Hamid Moheb, Clemmons, NC (US)

(73) Assignee: Prodelin Corporation, Newton, NC (US)

( * ) Notice: Subject to any disclaimer, the term of this patent is extended or adjusted under 35 U.S.C. 154(b) by 74 days.

(21) Appl. No.: 10/370,166

(22) Filed: Feb. 20, 2003

(65) Prior Publication Data

US 2004/0021614 A1 Feb. 5, 2004

Related U.S. Application Data

(60) Provisional application No. 60/358,164, filed on Feb. 20, 2002.

(51) Int. Cl.
*H01Q 13/02* (2006.01)

(52) U.S. Cl. ..... 343/781 R; 343/786

(58) Field of Classification Search ..... 343/786, 343/781 R, 781 P, 781 CA; 333/21 A
See application file for complete search history.

(56) References Cited

U.S. PATENT DOCUMENTS 4,356,495 A * 10/1982 Morz ..... 343/786
4,472,721 A * 9/1984 Morz et al. ..... 343/786
4,673,905 A 6/1987 Yamawaki et al.
5,552,797 A 9/1996 Cook
5,614,916 A * 3/1997 Mizuguchi ..... 343/786
6,005,528 A 12/1999 Preiss et al.

* cited by examiner

*Primary Examiner*—Michael C. Wimer
(74) *Attorney, Agent, or Firm*—Alston & Bird LLP

(57) ABSTRACT

The present invention provides a feed horn for use in an antenna assembly having a non-circular reflector. The feed horn is capable of transmitting and receiving circularly polarized signals. The feed horn includes a circular waveguide section for connection to a transmitter and receiver of the antenna assembly. A conical waveguide section is connected to an opposed end of the circular waveguide section for creating a smooth transition from the circular waveguide section to a non-circular corrugated waveguide section. The corrugated waveguide section includes a plurality of corrugations that transition for a circular shape adjacent to the conical waveguide section to an increasing non-circular shape at an end proximal to the reflector of the antenna assembly. The corrugations have individuals depths defined in the inner wall of the corrugated waveguide section. These depths compensate circularly polarized signals propagating in the feed horn for distortions due to the non-circular reflector.

27 Claims, 11 Drawing Sheets

CIRCULARLY POLARIZED RECEIVE/TRANSMIT ELLIPTIC FEED HORN ASSEMBLY FOR SATELLITE COMMUNICATIONS

CROSS-REFERENCE TO RELATED APPLICATIONS

This application claims priority from U.S. Provisional Patent Application No. 60/358,164, filed Feb. 20, 2002, entitled CIRCULARLY POLARIZED ELLIPTIC FEED HORN ASSEMBLY the contents of which are incorporated by reference herein in their entirety.

BACKGROUND OF THE INVENTION

1. Field of Invention

The present invention relates generally to corrugated feed horn assemblies and more particularly to a corrugated feed horn assembly for use in an antenna assembly having a non-circularly shaped reflector to transmit and receive circularly polarized signals.

2. Description of Related Art

An important design concern for most antennas is their overall size. Smaller antennas are desired for reasons of aesthetics and also for surface mounting requirements. While smaller sized antennas are advantageous, there are associated potential problems with performance caused by their smaller size. Recent advances, however, in the communication satellite industry have made it possible to use smaller antennas in two-way communications, commonly known as VSAT (very small aperture terminal) networks. These antennas typically range in circular aperture size from 60 cm to 4.5 m and provide acceptable performance for most applications.

Another problem in antenna design has been the production of antennas capable of communicating with closely spaced satellites. When satellites have geostationary orbits that are two degrees (2°) or less apart, their respective communication paths are in close proximity to one another when focused by a reflector to the feed assembly of an antenna. Because of this close proximity, there are typically concerns with interference between the two communication links. It is now possible, however, to build a system with antennas having significantly less gain than the conventional 3.8 m reflector antenna satisfying the two degrees (2°) satellite spacing. These antennas allow for communication with closely spaced satellites using one antenna. The solution is either to use larger circular reflectors with higher gain and narrower beam widths, or to use elliptical or rectangular reflector profiles.

The future of the satellite communication industry is leaning toward wider bandwidth to accommodate expanded services at lower cost. The current Ku-band (10.7–14.5 GHz) VSAT communication terminal operates in orthogonal linear polarization configuration to minimize the cross talk and to provide additional isolation between the transmit and the receive ports of an antenna. However, the allocated Ku-band suffers from limited capacity and data transfer speed. The alternative is to utilize the Ka-band (20/30 GHz), which offers wider bandwidth and higher data rate. The broadband technology is instrumental for high-speed interactive IP-based traffic, digital video, and multimedia applications.

On one hand, the satellite spacing requirement demands an elliptic aperture to eliminate cross-talk and to provide higher level of signal isolation at two degrees (2°) adjacency.

However, Ka-band satellites are typically designed to operate with circularly polarized signals either Right Handed or Left Handed (RHCP/LHCP) ground terminal. Communication systems that use circularly polarized signals require antennas with circular reflector profiles for total electrical symmetry. Specifically, a circularly polarized signal consists of two vector components that are ninety (90) degrees relative to each other. Further, the vector components have the same magnitude. To maintain the integrity of the signal, the vectors must remain substantially at the same magnitude, and they must remain substantially orthogonal to each other. Circular antenna reflectors maintain this electrical symmetry. Elliptical reflectors, on the other hand, do not because of their lack of symmetry in the horizontal and vertical directions. Consequently, there is a need for reflectors and feed horn assemblies that can accommodate the two degrees (2°) satellite rejection and at the same time operate in a circularly polarized environment.

The combined solution of cross-talk and circularly polarized requirements is an elliptical reflector profile that establishes two way communications links with satellites and functions in a circularly polarized environment. However, as mentioned, the reflector ellipticity destroys the system symmetry and creates a high level of axial ratio, due to reflector aspect ratio. The reflector ellipticity generates phase and amplitude degradation between the two orthogonal electric and magnetic fields. Consequently, it typically results in: (1) generation of extremely high cross-polarization, (2) extensive cross-talks between adjacent satellites, (3) degradation of co-polarized signal, (4) loss of transmit and receive power to the link satellite, (5) lower Effective Isotropic Radiation Power (EIRP), (6) higher system and background noise temperature, and (7) loss of satellite link.

BRIEF SUMMARY OF THE INVENTION

The present invention provides a feed horn for use in an antenna assembly having a non-circular reflector. The feed horn of the present invention is designed such that it allows the antenna assembly to support two-way (receive/transmit) communication of circularly polarized signals. The feed horn is capable of transmitting and receiving circularly polarized signals. The feed horn includes a circular waveguide section for connection to a transmitter and receiver of the antenna assembly. A conical waveguide section is connected to an opposed end of the circular waveguide section for creating a smooth transition from the circular waveguide section to a non-circular corrugated waveguide section. The corrugated waveguide section includes a plurality of corrugations that transition for a circular shape adjacent to the conical waveguide section to an increasing non-circular shape at an end proximal to the reflector of the antenna assembly. The corrugations have individuals depths defined in the inner wall of the corrugated waveguide section. These depths compensate circularly polarized signals propagating in the feed horn for distortions due to the non-circular reflector.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As discussed above, one of the challenges of the present invention is to provide an antenna having an elliptical reflector and antenna feed to meet the requirements for closely spaced satellites, while at the same time providing an antenna that maintains the electrical symmetry of a circularly polarized signal. As two-way communication is desired, the antenna system should also be designed to maintain symmetry for both transmit and receive signals.

Figures 1A, 1B:
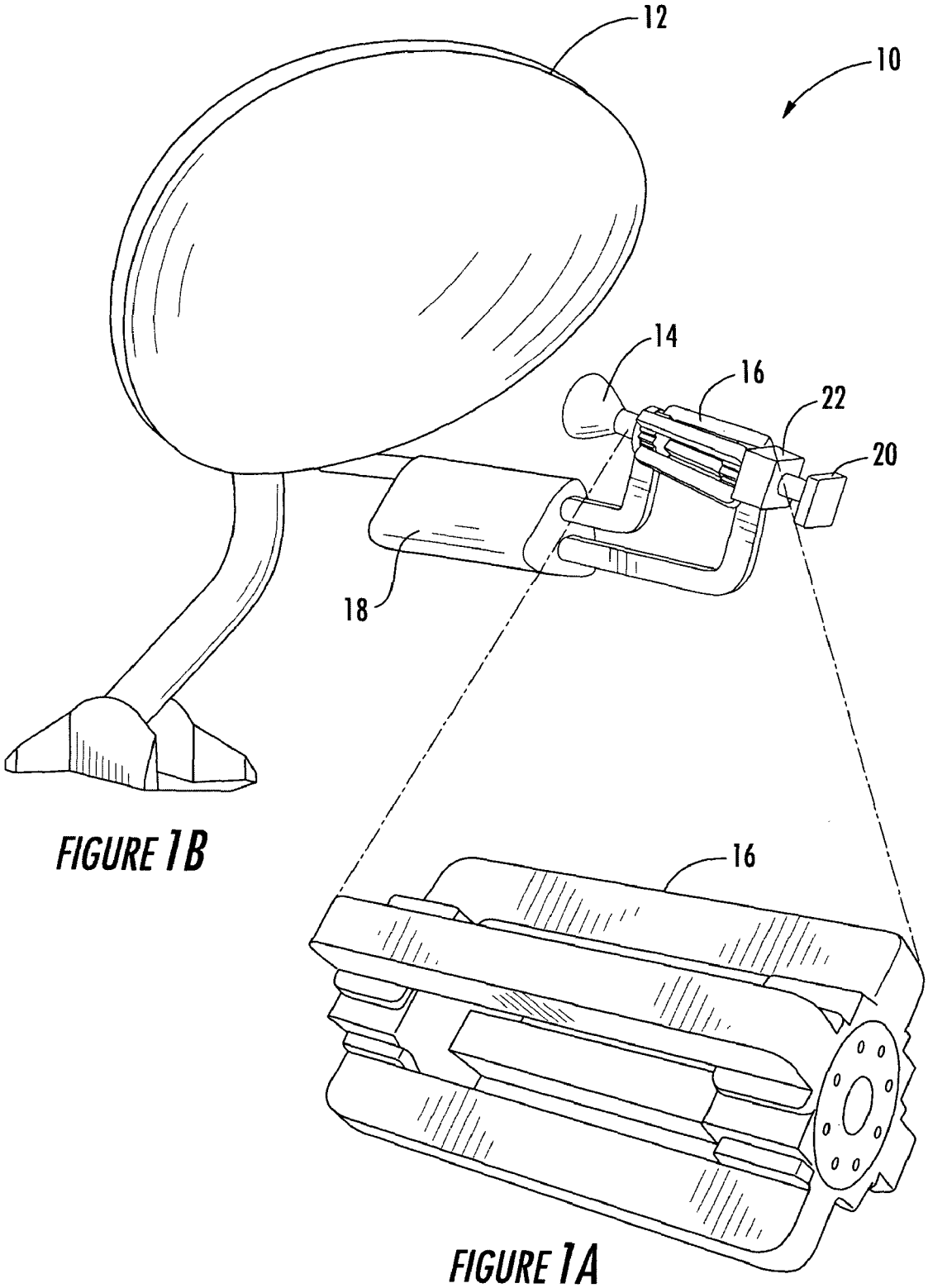
FIGS. 1A and 1B are perspective views of an antenna assembly according to one embodiment of the present invention that includes an elliptic reflector and an elliptic feed horn with a phase compensator used to match the reflector/ horn ellipticity with that of associated microwave components.

FIGS. 1A and 1B illustrates one embodiment of an apparatus for compensating for symmetry problems with elliptical reflectors and feeds in a system used for communication circularly polarized signals. This embodiment includes an antenna 10 having an elliptical shaped reflector 12. To overcome the technical difficulties of ellipticity of the reflector, the system can be designed to utilize a linearly polarized elliptic feed horn 14 to properly illuminate the reflector illumination and a phase compensator 16 to match the reflector/horn ellipticity with that of associated microwave components. Specifically, with reference to FIG. 1B, the phase compensator 16 of this embodiment comprises a four-port waveguide phase and amplitude compensator to adjust the phase differential between the two fundamental modes. The standard approach is to load the waveguide with periodic conductive and capacitive irises in order to generate phase delay or phase advance respectively. The waveguide itself has either a square or circular cross-section to provide physical and electrical symmetry. The introduction of irises into square cross-section waveguide acts as an inductance for TE10 mode, and shunt capacitance for TE01 mode. As a result, one mode is delayed while the other is advanced creating 90 degrees phase differential between the two orthogonal modes. The 90 degrees phase and equal amplitude is essential in either transmit (30 GHz) or receive (20 Ghz) band to provide a circularly polarized signal.

By using the four-port waveguide phase and amplitude compensator 16, the alterations in symmetry of circular polarized signals caused by elliptical reflectors and feed horns can be compensated. Specifically, the four-port waveguide phase and amplitude compensator 16 is located between the feed horn 14 and the transmitter 18 and receiver 20 of the antenna. The transmitter and receiver are connected to the compensator via an ortho-mode transducer (OMT) 22, which allows for propagation of both transmit and receive signals in the multiplexer structure. A circular polarized signal transmitted by the transmitter for communication to a satellite is input to the four-port compensator. The compensator alters the symmetry of the circular polarized signal in accordance with the electrical asymmetry of the elliptical feed horn and reflector. The symmetry is altered such that when the circularly polarized signal is reflected from the reflector to the satellite, the circular polarized signal again has symmetry corresponding to the way the signal was transmitted by the transmitter.

In a similar manner, signals transmitted from a satellite to the antenna are circularly polarized with electrical symmetry. The electrical symmetry, however, is distorted by the elliptical reflector 12 and elliptical feed horn 14 of the antenna. The four-port waveguide phase and amplitude compensator of the present invention restores electrical symmetry to the signal prior to input to the receiver 20.

An important aspect of the four-port compensator 16 of FIGS. 1A and 1B is that it takes advantage of available waveguide technology. It can be implemented by piecing together of waveguides having selected properties to provide for proper signal compensation. Although the system provides a practical solution to the problem, there are some possible drawbacks to this solution. Specifically, the compensator is a relatively large unit, has added weight and cost, and can have unacceptable insertion losses.

In light of this, the present invention provides an alternative approach to signal compensation and correction. Specifically, the present invention provides a single-piece feed horn having phase compensation embedded therein. The feed horn has a non-circular shape, (typically elliptical), and comprises a series of corrugations. Each corrugation has a specific elliptic shape and thickness. The corrugations transition from more elliptical in shape to more circular in shape in a direction from the front of the feed horn that faces the reflector of the antenna to the back of the feed horn that connects to the receiver and transmitter sections. The corrugations are designed such that they compensate for the changes in a circularly polarized signal caused by the elliptical reflector and feed horn. Importantly, this phase compensated feed horn reduces the size and complexity of the feed system assembly over that of the compensation system illustrated in FIGS. 1A and 1B.

Figure 2:
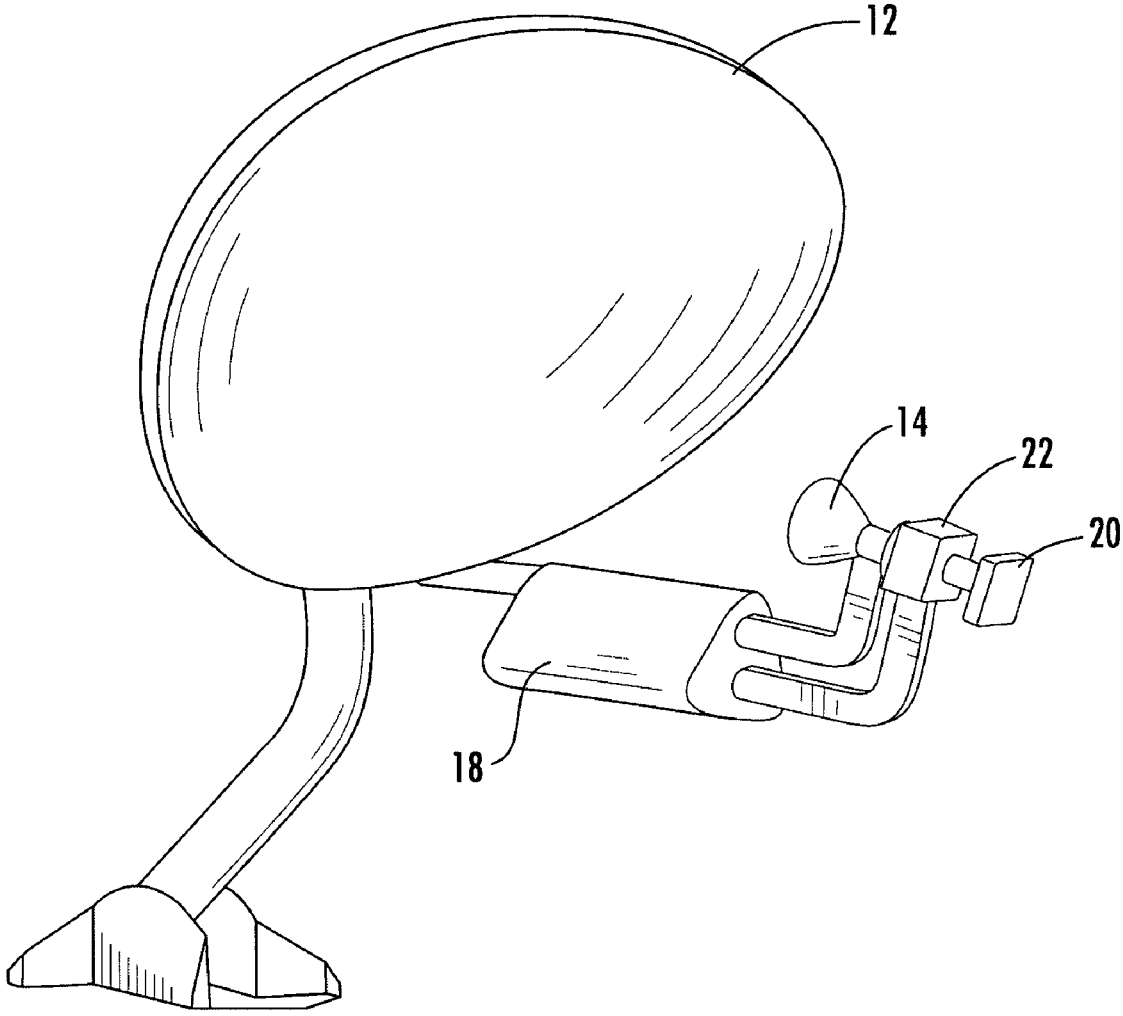
FIG. 2 is a perspective view of an antenna assembly according to one embodiment of the present invention that includes an elliptic reflector and an elliptic feed horn, wherein the feed horn includes a phase compensator embedded therein used to match the reflector/horn ellipticity with that of associated microwave components.

In particular, FIG. 2 illustrates a perspective view of an antenna assembly incorporating a feed horn according to one embodiment of the present invention. As illustrated, the antenna assembly 10 includes an elliptically shaped reflector 12. Located opposite the reflector is a feed assembly comprising an elliptically shaped feed horn 24 connected to an OMT 20 and a transmitter 18 and receiver 20. As will be discussed in greater detail below, the feed horn 24 of the present invention allows for circularly polarized two-way receive/transmit communication using an elliptic feed horn and elliptic reflector.

Due to reflector ellipticity, the design of the phase compensated feed horn is challenging. The feed horn requires equal power splitting between the two orthogonal modes of a circularly polarized signal; on the other hand, it should have different phase progression for each mode due to reflector and horn ellipticity. The presence of hybrid modes in the elliptic horn structure further complicates the phase differential and amplitude splitting between the two fundamental modes. The mode functions themselves are radial and angular Mathieu odd and even functions with nonvanishing roots. As a result, the phase and amplitude modeling becomes a tedious task, coupled with radiation characteristics of the elliptical feed horn. This modeling is described in greater detail below.

The present invention provides a circularly polarized two-way Rx/Tx circularly polarized elliptic feed horn assembly. The developed Ka-band system is a corrugated noncircular conical horn with embedded phase compensators that works with elliptical and/or noncircular reflector profiles. The reflector optics is a single offset elliptic design to provide narrow beam in the azimuth plane. As known in the art, the single offset offers simplicity in installation and is less susceptible to rain and snow accumulation. The water build up is quite critical especially at 20/30 GHz band.

In the embodiments discussed herein, the reflector is typically illustrated as elliptical in shape and the feed horn has an elliptic shape for communication with the reflector. It must be understood that present invention is not restricted to elliptical configurations, and may be used with any noncircular shaped reflector and corresponding feed horn. Specifically, using the equations discussed infra, a corrugated feed horn having any shape can be designed such that the depths that the corrugations extend into the inner wall of the feed horn properly compensate a circularly polarized signal propagating therethrough for distortions caused by a noncircular reflector. The depths for each corrugation can be determined using the equations such that a plurality of corrugations can collectively compensate the signal.

Figure 3:
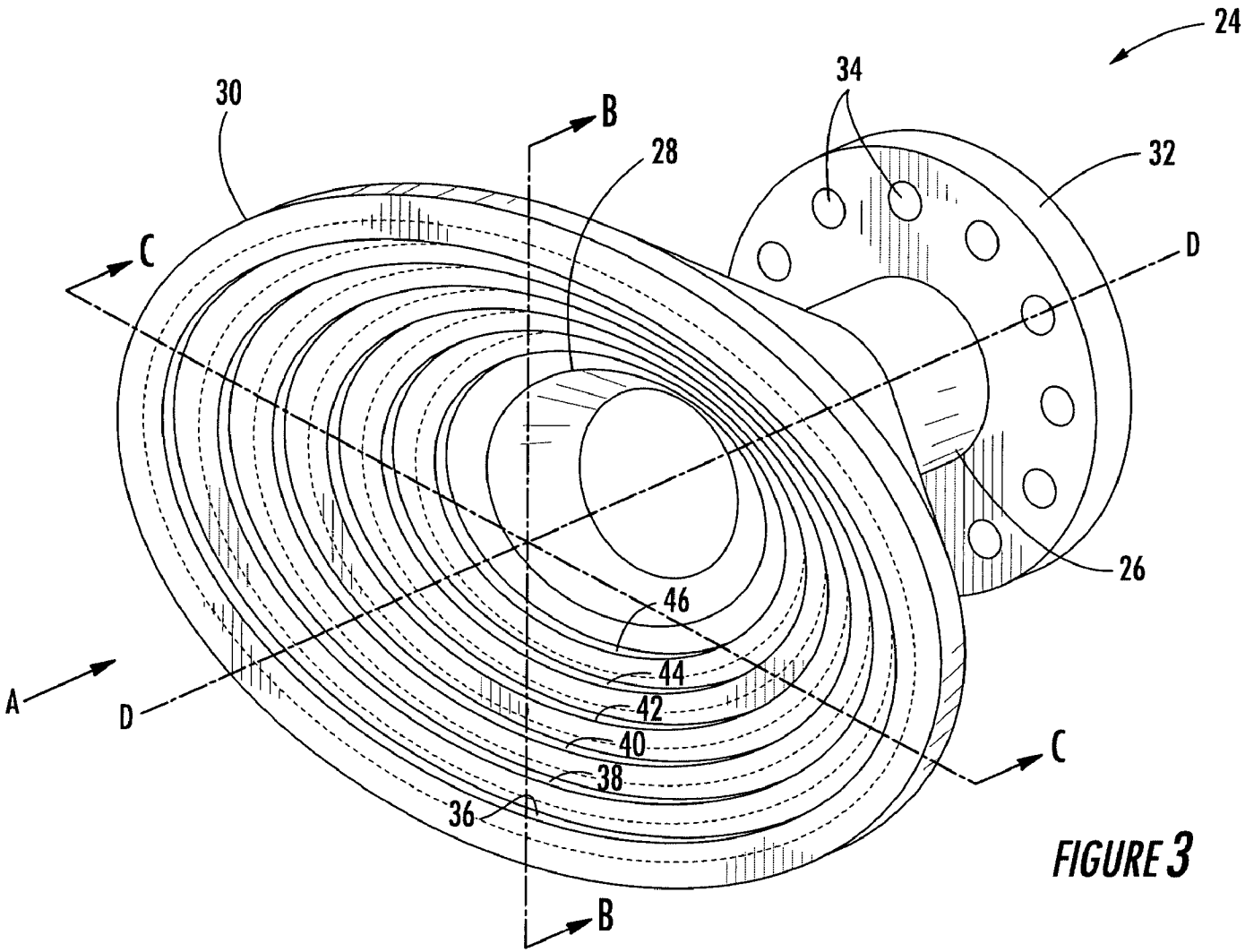
FIG. 3 is perspective view of the feed horn of FIG. 2 according to one embodiment of the present invention.

FIG. 3 illustrates an embodiment of the system configuration. Importantly, the present invention includes a feed horn 24. The feed horn is designed to properly illuminate the elliptic reflector aperture while operating in both RHCP/LHCP polarizations. As illustrated, in one advantageous embodiment, the feed horn includes three sections, namely a circular hollow waveguide section 26, a conical section 28, and a corrugated feed horn section 30. The feed horn 24 includes a flange 32 containing a series of apertures 34 for connection to an OMT 22 to thereby place the feed horn in communication with a transmitter 18 and receiver 20. The conical section and feed horn section extend from the circular hollow waveguide section in a direction toward the reflector of the antenna assembly.

Importantly, the circular waveguide section 26 is a hollow waveguide having a circular cross-section to support both receive (19.7–20.5 GHz) and transmit (29.5–30.3 GHz) Ka-bands. The hollow waveguide's cross-section is chosen so as to insure the propagation of the two orthogonal dominant modes of the circularly polarized signal, and prevent the excitations of higher order modes. The circular waveguide section's length is optimized in conjunction with the conical 28 and corrugated section 30 to ensure proper phase and amplitude at the horn flange interface.

With regard to the conical section 28, this section is a transitional region between the circular waveguide section 26 and the corrugated section 30. The throat region of the conical section is a smooth conical section to provide low return loss at both bands and a low level of higher order modes. The conical section is about 0.3λ in length at the receive band for good electrical match and subsequently superior axial ratio performance. The conical section has a wide semiflare angle θ greater than 20°, (see FIGS. 4A and 4B), to illuminate the reflector with a proper copolar radiation pattern. The throat region is instrumental to control the input impedance and the mode conversion from a smooth circular waveguide section 26 to the elliptic corrugated horn 30 opening for low VSWR. The low VSWR is necessary to obtain excellent cross-polarization for both RHCP and LHCP operation.

Connected to the conical section 28 is a corrugated section 30 comprising a series of elliptical corrugations rings 36–48. The shape of the corrugations provides optimum patterns at both transmit and receive bands. Importantly, the corrugations or propagation rings 36–48 are designed to compensate for unequal phase and amplitude distribution of a noncircular profile. Each propagating ring is optimized so as to provide proper phase and amplitude between the fundamental modes of a circularly polarized signal propagating therethrough keeping the appropriate edge illumination. The corrugation or propagating rings are designed for operation over a transmit/receive band for total symmetry of E- and H-fields with proper phase differential. The propagating ring size is gradually increased toward the horn aperture to control the reflector edge illumination.

More specifically, with reference to FIG. 3, the corrugation section 30 of the present invention transitions from an elliptical shape at the first propagating ring 32 that matches the elliptical shape of the reflector of the antenna to a circular shape 44 that matches the conical waveguide section 28. Specifically, in the direction A signifying a path from the reflector of an antenna to a receiver of an antenna, the propagation rings transition from more elliptical shapes to more circular shapes. Each propagation ring includes a major and a minor axis. The ratios between the major and minor axes for the first propagation ring 32 is greater than that of next propagation ring 34, and so on to the point where the last propagation ring 44 meets the circular throat of the conical section 28.

In effect, the propagation rings transition a signal propagating in the direction A from the reflector to a receiver from an elliptical to a circular signal. Similarly, for signals propagating in a direction opposite of A from a transmitter to the reflector, the propagation rings transition the signal electrically from a circular signal to an elliptical signal to match the ellipticity of the reflector of the antenna.

As discussed above, a circularly polarized signal has two components with equal magnitude that are orthogonal to each other. The ellipticity of the reflector distorts the signal either by altering the magnitude of the components, altering their phase relative to each other, or both. As illustrated with reference to FIGS. 1A and 1B, the signals must be compensated to correct for the effects of the elliptical reflector. The propagation rings, 36–48, of the feed horn of the present invention act as compensators similar to the compensators of the device of FIGS. 1A and 1B.

Figure 4B:
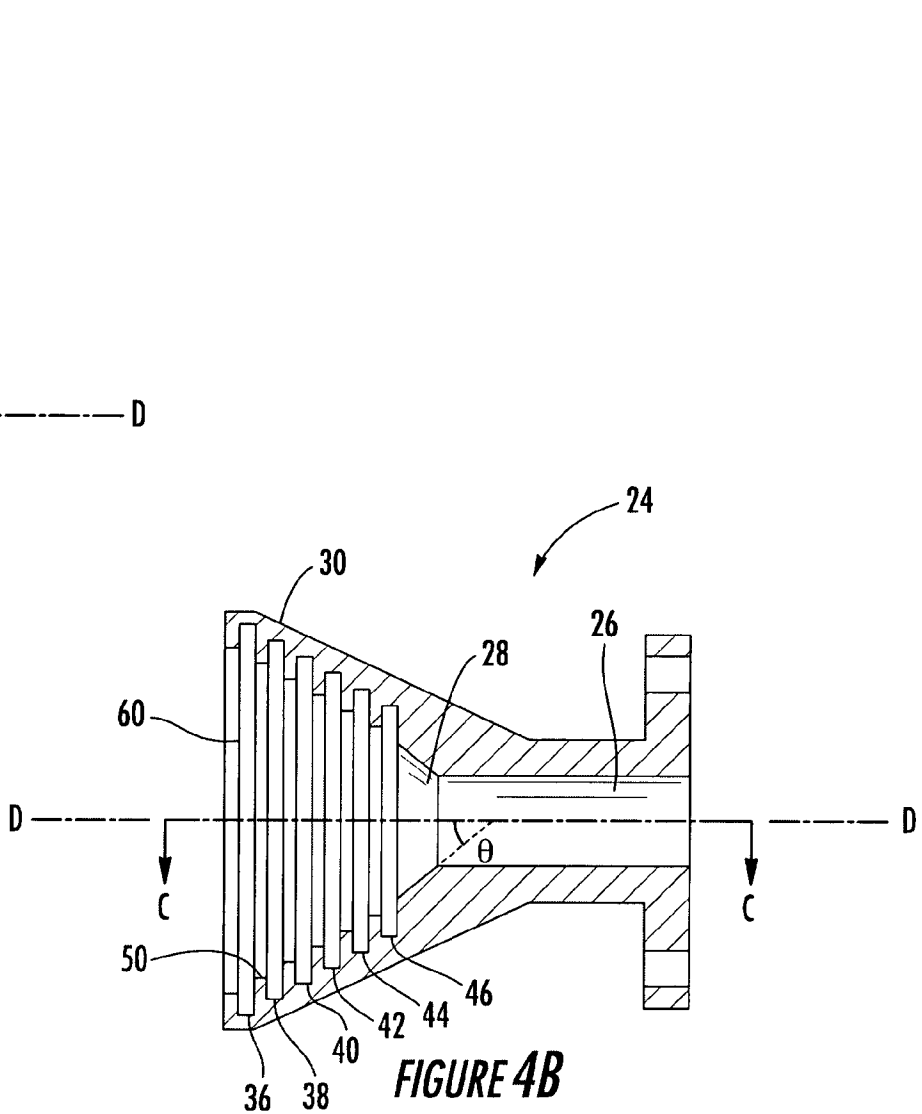
FIG. 4B is a cross-sectional view of the feed horn taken along cross-section line C according to one embodiment of the present invention.
Figure 4A:
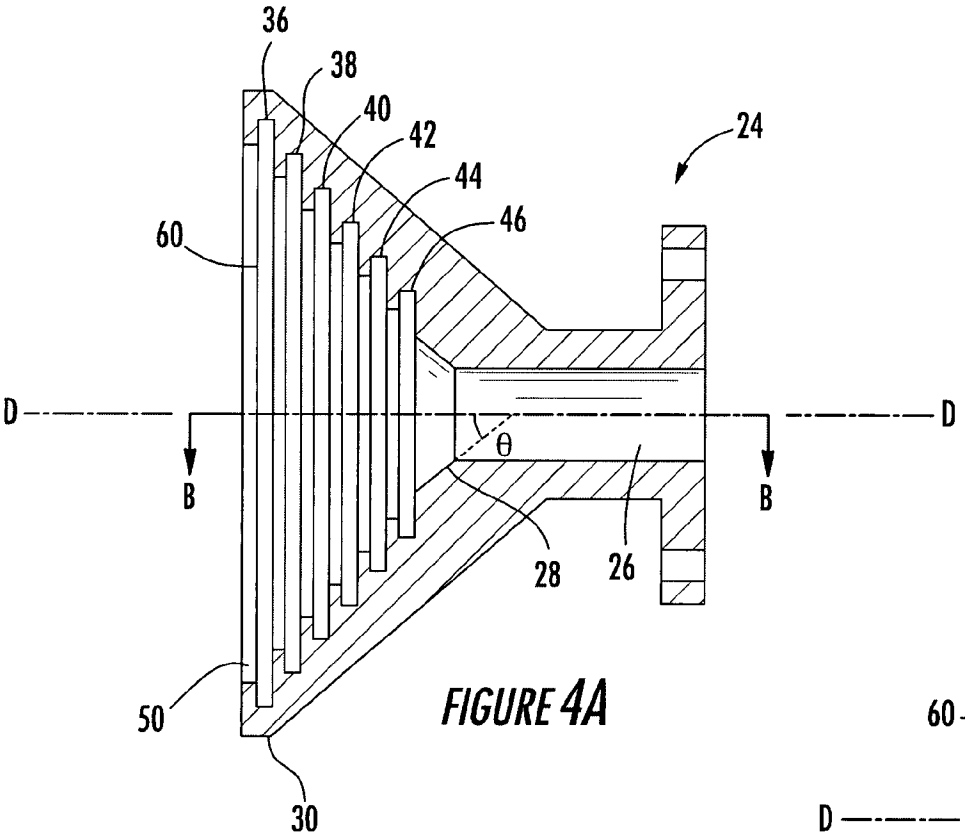
FIG. 4A is a cross-sectional view of the feed horn taken along cross-section line B according to one embodiment of the present invention.
Figure 4C:
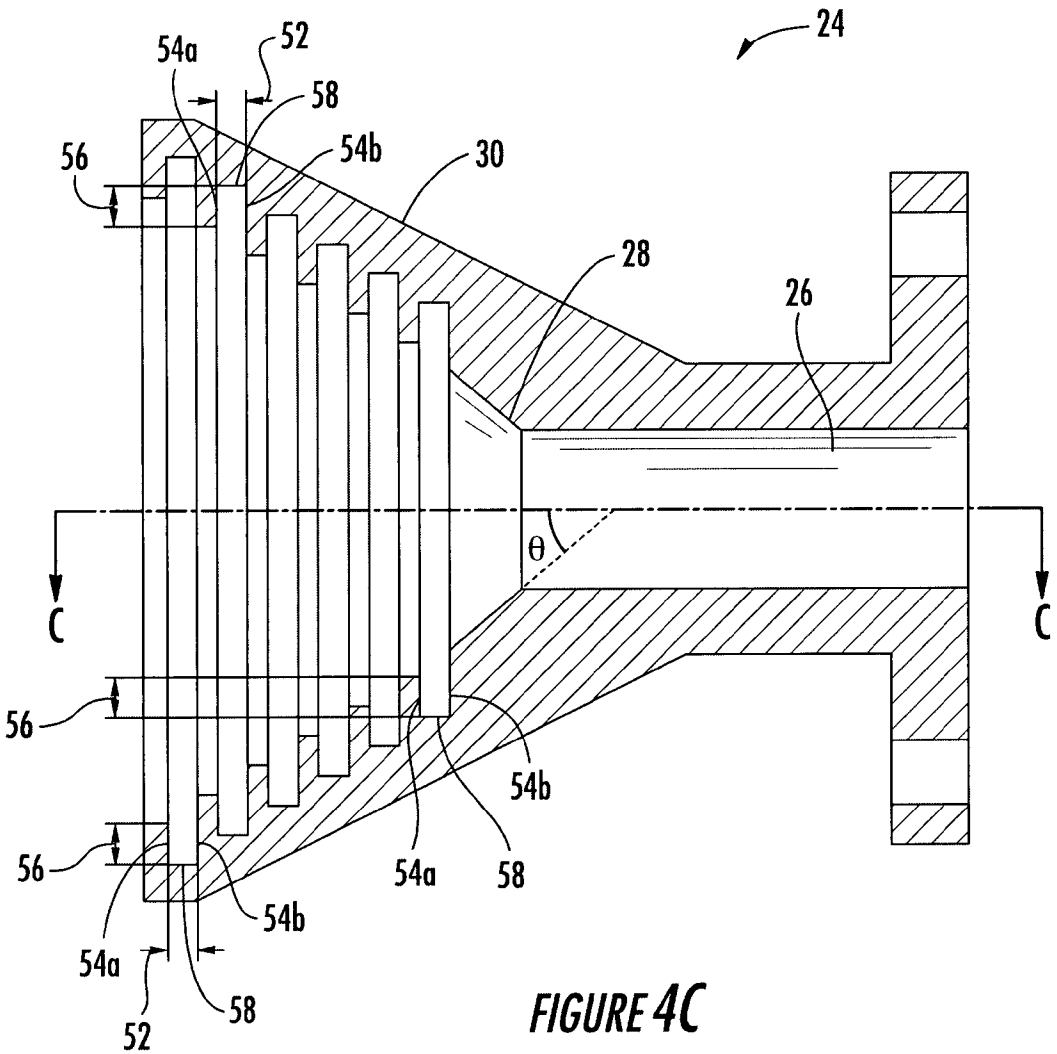
FIG. 4C is an exploded cross-sectional view of the feed horn taken along cross-section line C according to one embodiment of the present invention.
Figure 5:
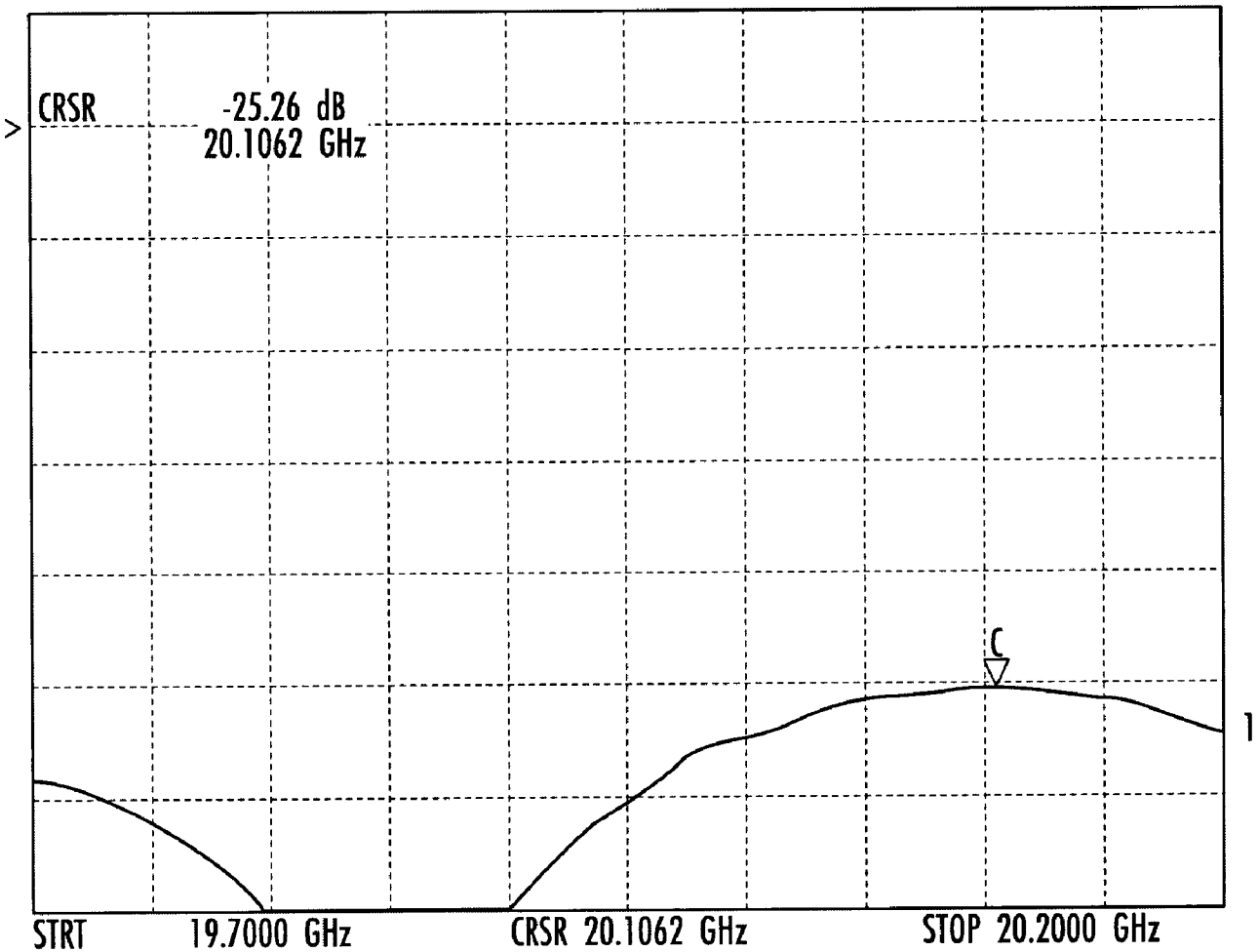
FIG. 5 is graph illustrating the return loss of the feed horn in the receive band according to one embodiment of the present invention.
Figure 6:
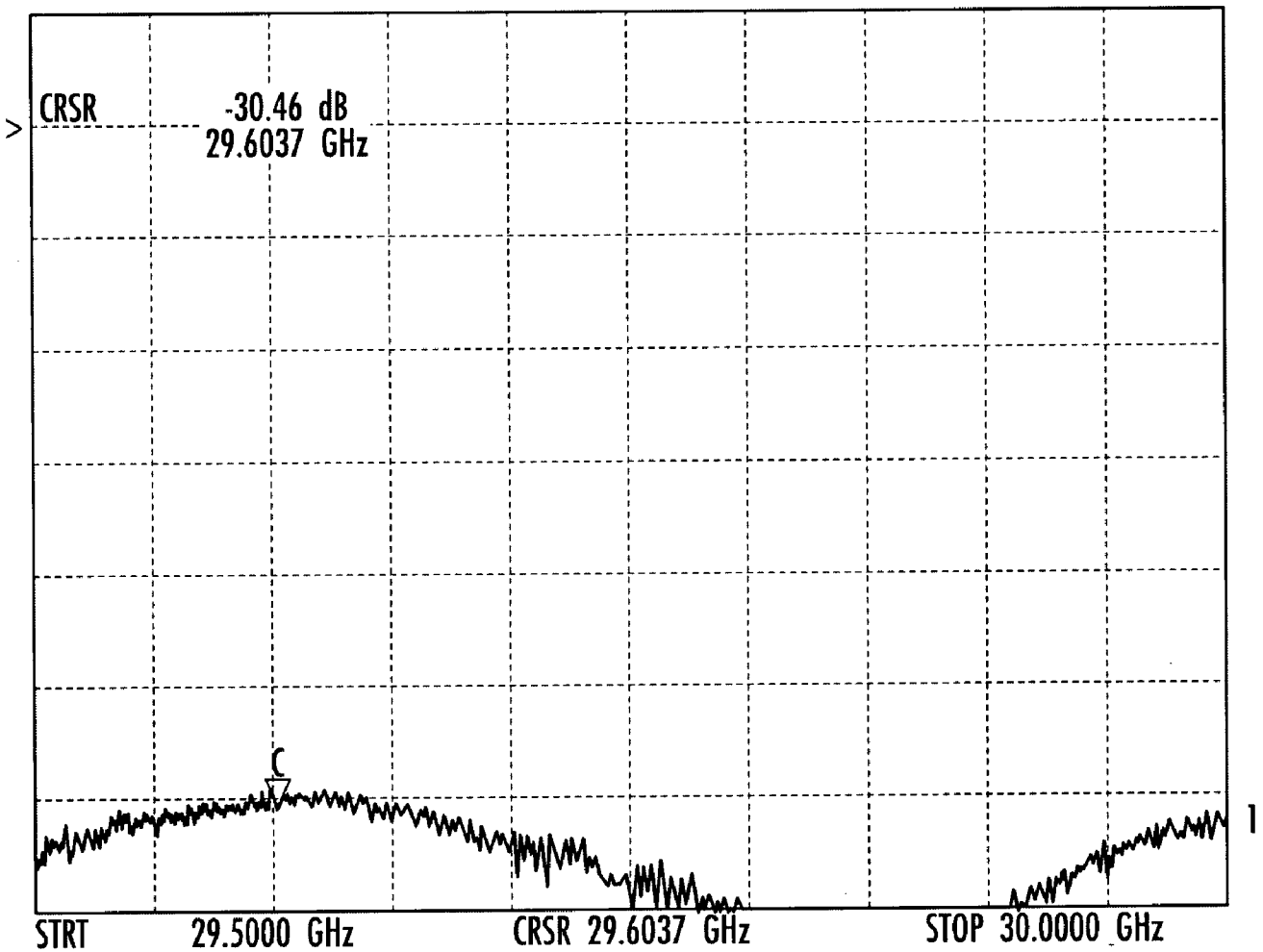
FIG. 6 is graph illustrating the return loss of the feed horn in the transmit band according to one embodiment of the present invention.

With reference to FIGS. 4A–4C, the feed horn has an axis of symmetry D extending longitudinally through the circular waveguide section 26, conical waveguide section 28, and corrugated section 30. In the corrugation section, a series of corrugations, 36–48, are spaced along the longitudinal axis D. The corrugations are a series of grooves in the inner wall 50 of the corrugation section 30. Each groove can be seen in the cross-section transverse to the longitudinal axis as an elliptical disc having a thickness 52 defined by two sidewalls, 54*a* and 54*b*. The bottom 58 of each groove defines an outer perimeter that extends into the thickness of the inner wall by a defined depth for each groove and side walls extending from the outer perimeter to the inner wall of said corrugated waveguide section. The sidewalls of each corrugation are at a right angle to the longitudinal axis of symmetry D. In other words, in the transverse cross-section, the elliptical disc forming each corrugation is perpendicular to the longitudinal axis.

As illustrated, the upper extensions of the sidewalls, 54*a* and 54*b*, form the boundary for an inner cavity 60 in the feed horn. From this boundary, the sidewalls extend in a direction perpendicular to the longitudinal axis D into the feed horn to corrugation depths 56. The corrugations each have a different elliptical shape that transitions from a more circular shape near the conical section 28 and increased ellipticity near the horn aperture. The corrugation depth 56 is defined as the distance from the inner boundary 50 of the corrugated section to the bottom 58 of the corrugation. The corrugation depth 56 varies as a function of the each corrugation's ellipticity in the transverse cross-section.

The depth of each corrugation acts as a compensator for the feed horn. Specifically, the depth of each corrugation compensates for the distortions caused by use of an elliptical reflector to reflect a circularly polarized signal. More specifically, a circularly polarized signal propagating along the path A from the reflector to a receiver enters the first propagation ring 32 in a distorted condition caused by the elliptical reflector. The depth of the first propagation ring somewhat compensates for this distortion. Each successive propagation ring further compensates the signal, such that when it enters the conical section 28 of the feed horn, it is substantially a circularly polarized signal having components of substantially the same magnitude and substantially orthogonal to each other, as is required of a circularly polarized signal.

The depth of the corrugations are selected between 0.25λ and 0.5λ and optimized to ensure proper local phase and amplitude. The depths are determined based on analysis of the modes of the circularly polarized signal. Specifically, the depth for each corrugation is determined such that the corrugation contributes to the overall correction of the circularly polarized signal, such that a distorted circularly polarized signal entering the feed from the reflector is corrected by each corrugation such that it enters the conical section as a circularly polarized signal and visa versa for signals traveling from the conical section to the reflector. As is described later below, the depth of each corrugation is selected by first determining the compensation contribution for every point on the corrugation as a function of the corrugations distance R from the field. The depth of the corrugation is determined to provide the compensation desired for the corrugation. This is described below.

Figure 7:
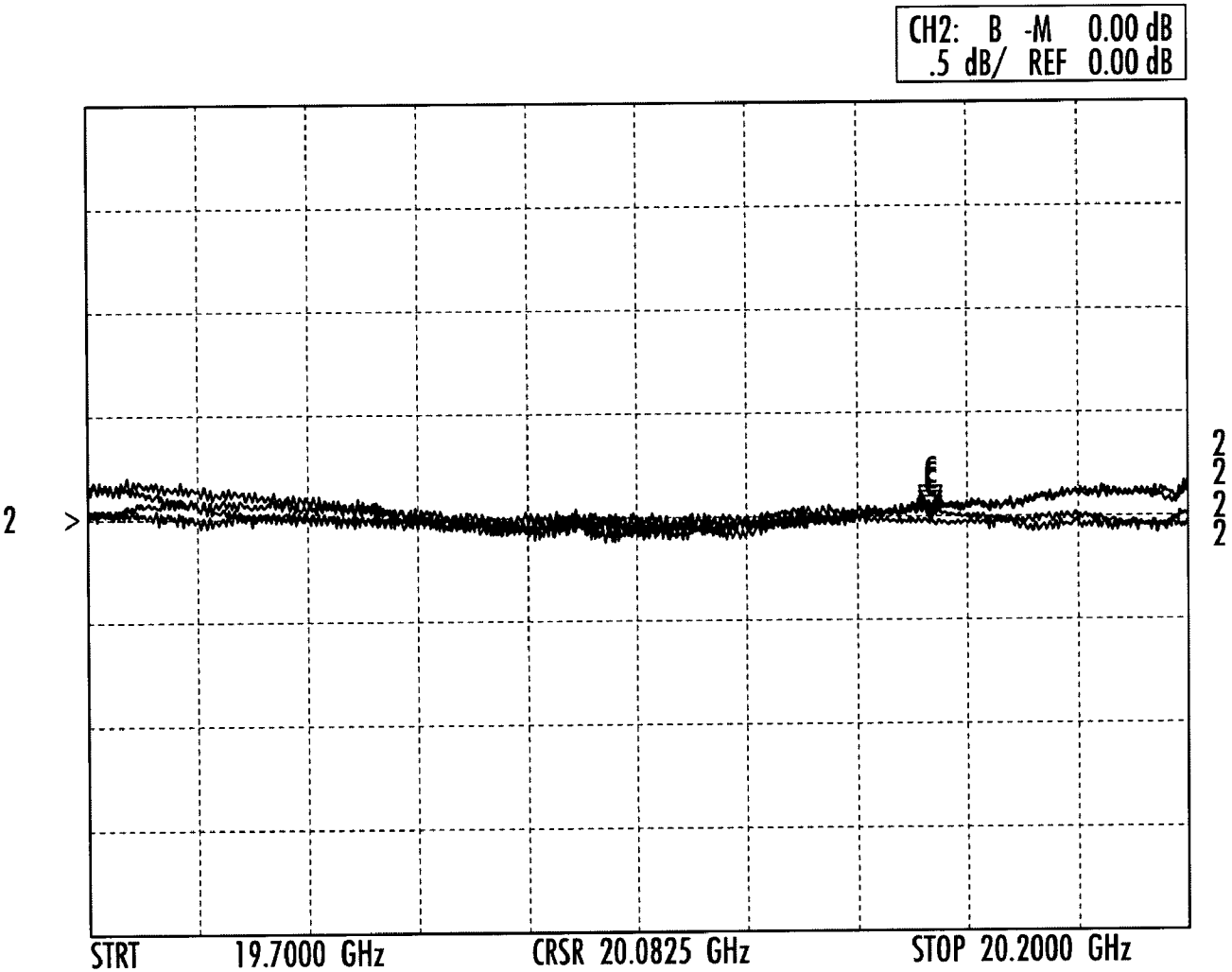
FIGS. 7 and 8 are graphs illustrating the typical measured axial ratio of the system, which includes the feed horn, polarizer, an ortho-mode transducer (OMT), and associated isolation filters according to one embodiment of the present invention.
Figure 8:
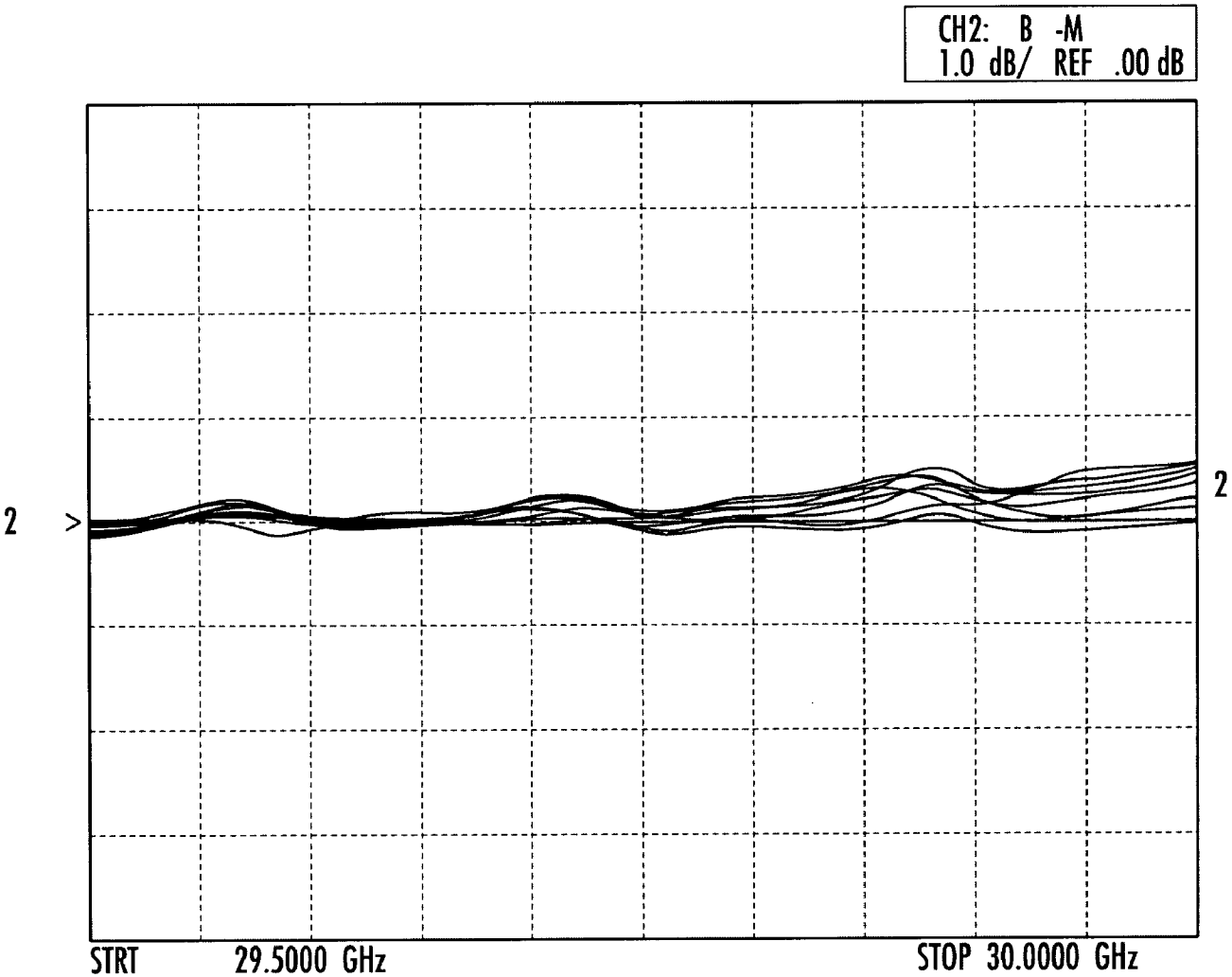
Figure 9:
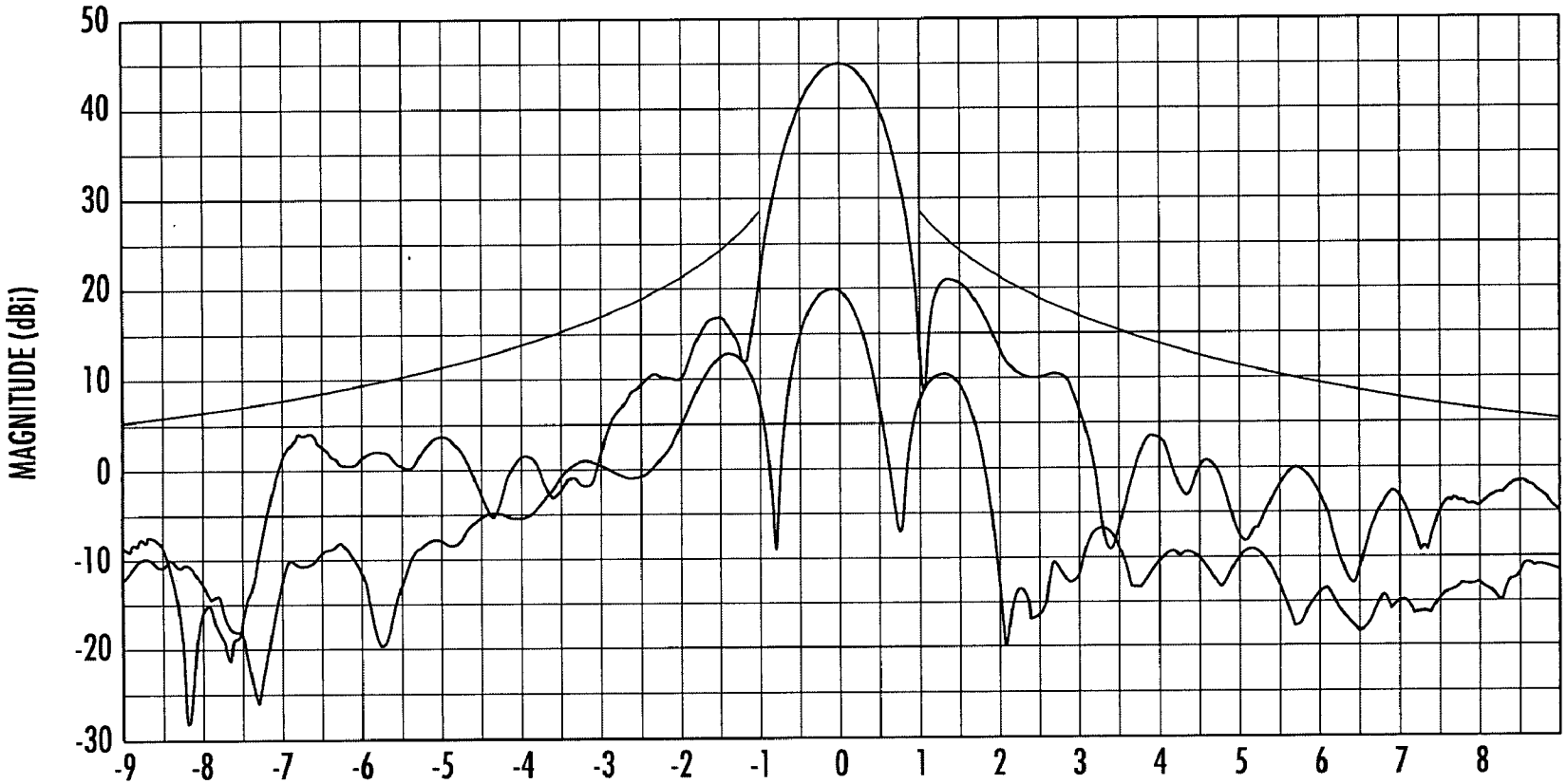
FIG. 9 is a graph illustrating measured radiation patterns at both receive/transmit midband of the elliptic reflector and the feed horn assembly according to one embodiment of the present invention.

The systems electrical performance, i.e., return loss, axial ratio and radiation patterns are provided in FIGS. 5–9. With regard to FIGS. 5 and 6, the measured return loss is better than 20 dB over the receive and the transmit bands. FIGS. 7 and 8 show the typical measured axial ratio of the system, which includes the feed horn, polarizer, an OMT and associated isolation filters. The measured axial ratio is better than 0.5 dB, which translates to cross-polarization of better than 30 dB. The measured radiation patterns at both receive/transmit midband of the elliptic reflector and the feed horn assembly are depicted in FIG. 9. As shown, the elliptic reflector provides excellent sidelobe and cross-polarization performance.

As discussed, the heart of the system was to design a feed horn to properly illuminate the elliptic reflector aperture while operating in both RHCP/LHCP polarizations. The optimum feed candidate is the corrugated elliptical horn, which provides optimum pattern at both transmit and receive bands. The feed horn corrugations are designed so as to compensate for unequal phase and amplitude distribution of a noncircular profile. Each corrugation is optimized so as to provide proper phase and amplitude between the fundamental modes, while keeping the appropriate edge illumination. The corrugations were designed for operation over a transmit/receive band for total symmetry of E- and H-field with proper phase differential.

Figure 10:
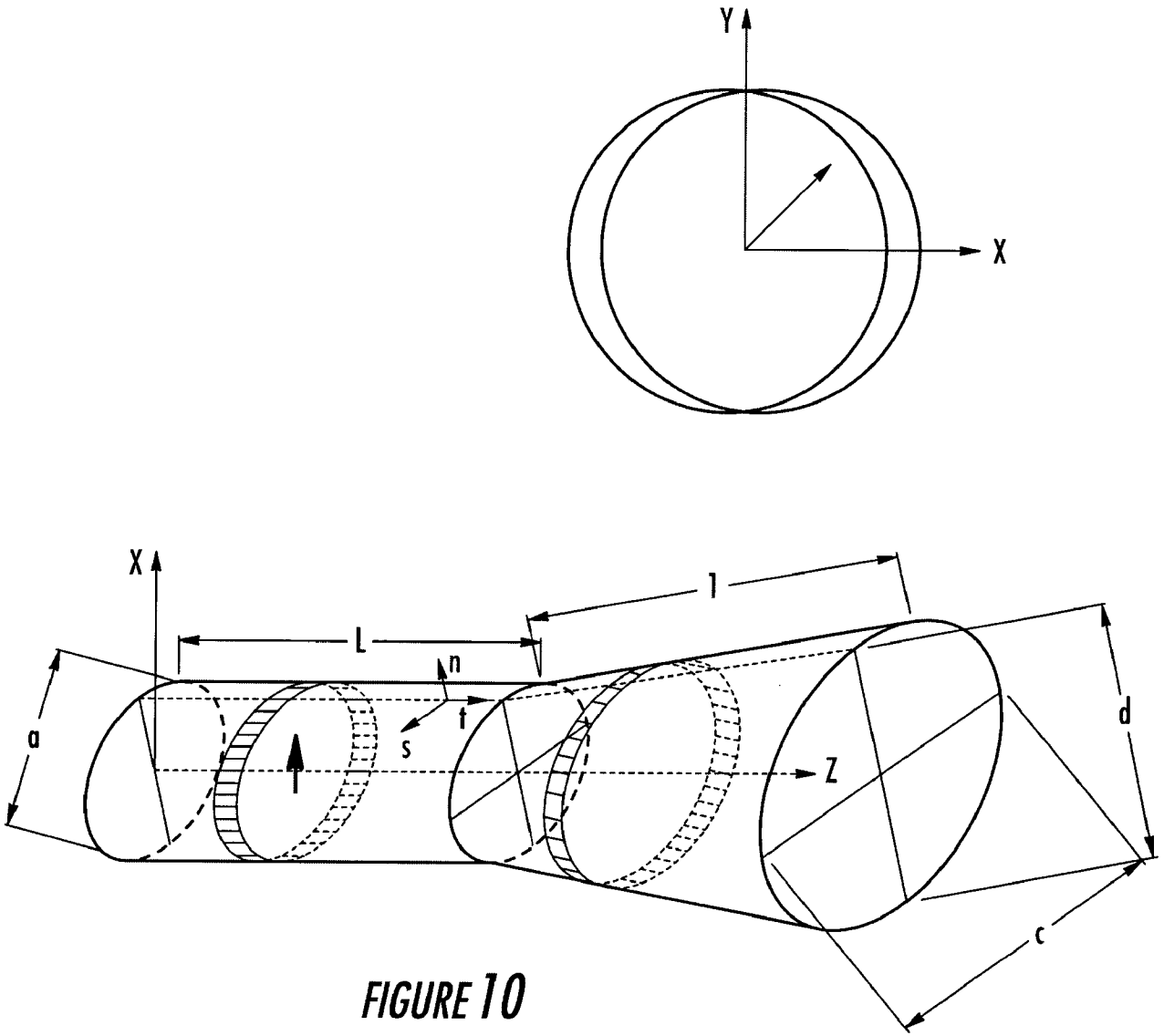
FIG. 10 is a graphic illustration a corrugated feed demonstrating the calculations used to determine the depth of the corrugations.

Provided below with reference to FIG. 10 is a description of the numerical technique and an outline of the solution method used to calculate the size of the individual corrugations. Similar to the rotationally symmetric objects, two hybrid orthogonal unit vectors are defined. Along one, surface currents are represented by discrete overlapping triangle basis functions and along the cross-section by entire domain basis functions in the form of Fourier modes. See A. R. Jamieson and T. E. Rozzi, "Rigorous analysis of cross-polarization in flange-mounted rectangular waveguide radiators," *Electron. Lett.*, 13, 742–744 (1977) for a more detailed discussion of this aspect. The Jamieson and Rozzi article is incorporated herein by reference. To enable the latter, the horn's cross-section is conformally transformed onto a unit circle. The two co-ordinate systems are then interrelated through the Jacobian of the transformation. However, owing to the transformation of the geometry, the selected Fourier modes of the transformed domain are not eigen-functions of the geometry and couple on the surface. These current modes are dependent on the horn's cross-section, but converge rather rapidly. The method of moments is used to solve the electric field integral equation to determine the surface currents. (See H. Baudrand, J. W. Tao and J. Atechian, 'Study of radiating properties of open-ended rectangular waveguides', *IEEE Trans. Antenna Propag.*, AP-36, 1071–1077 (1988), which is incorporated herein by reference.). These currents are then used to compute the radiation patterns and cross-polar fields of the rectangular waveguides or horns.

The formulation of the elliptic corrugated horn is in terms of the electric field integral equation (EFIE). The electric field exterior to an object's surface can be expressed in terms of a vector potential A(J) and a scalar potential φ(J) as $$E^S = -j\omega A(J) - \nabla\phi(J) \tag{1}$$

$$A(J) = \mu \int\int_s J(r')\frac{e^{-jkR}}{4\pi R}\,ds' \tag{2}$$

-continued $$\phi(J) = \frac{1}{\varepsilon}\int\int_s \sigma \frac{e^{-jkR}}{4\pi R}\, ds' \tag{3a}$$

where $\mu$ and $\epsilon$ are the permeability and permittivity respectively of the medium, J is the electric surface current, $\sigma$ is the surface charge density defined as, $$\sigma = \frac{-1}{j\omega}\nabla_s \cdot J \tag{3b}$$

and R is the distance between the field and source points on S, $\omega$ is the radian frequency, where a time factor $e^{j\omega t}$ is assumed. An integro-differential equation for the surface current is derived from the recognition that the total electric field tangent to the object must be zero on its surface. Similar to the scattering problems, the current on the wave-guide's surface is decomposed into two components along two orthogonal hybrid tangent vectors t and s, (see FIG. 10), defined by $$\hat{U}_t = \sin\beta \hat{U}_p + \cos\beta \hat{U}_z \tag{4}$$

$$\hat{U}_s = -\sin\alpha \hat{U}_i + \cos\alpha \hat{U}_j \tag{5}$$

where $\hat{U}_p$, $\hat{U}_z$, $\hat{U}_i$, and $\hat{U}j$ are unit vectors in the p, z, x, and y directions such that $n=\hat{U}_s \times \hat{U}_t$, and n is the unit normal to the surface. In equations (4) and (5), $\beta$ represents the angle between the unit vector $\hat{U}_t$ and the z-axis, and $\alpha$ is the angle which is used to define the unit vector $\hat{U}_s$ on different portions of the surface contour in the xy plane. The expansion and evaluation of the surface current J, and the reduction of the integral equation to a matrix equation follows the procedure of the moment method. That is, $$J(r) = \hat{U}_p \sum_{n=-\infty}^{\infty}\sum_{j=1}^{N} a_{nj}^p J_{nj}^p \quad p = t \text{ or } s \tag{6}$$

where $\alpha^P_{nj}$ are unknown current coefficients to be determined and $J^P_{nj}$ are the basis functions defined by $$J^P_{nj} = \hat{U}_p f_j(t) e^{jn\xi} \tag{7}$$

In equation (7), t represents the arc length along a selected generating curve C of the structure. Similar to bodies of evolution, $f_t(t)$ is selected as an overlapping triangle basis function which spans the generating curve, n is the mode number along the vector s, and $\xi$ is the azimuthal angle measured from the x-z plane in the transformed co-ordinate system. (See R. H. Macphie and A. I. Zaghloul, 'Radiation from a rectangular waveguide with infinite flange—exact solution by the correlation matrix method', *IEEE Trans. Antenna Propag.*, AP-28, 497–503 (1980), which discusses overlapping triangle basis functions and is incorporated herein by reference.). Using the testing functions $W^P_{mi}=J^P_{nj}{}^*$, to reduce the integral operator to a set of algebraic linear equations, gives $$\sum_{n=-\infty}^{\infty}\sum_{j=1}^{N} (Z_{mn}^{pq})_{ij} a_{nj}^p = V_{mi}^p \quad m = 0, \pm 1, \pm 2, \ldots \tag{8}$$

Where $(Z^{pq}_{mn})_{ij}$ is a square matrix representing the impedance operator and $V^P_{mi}$ is the excitation column matrix given by, $$V_{mi}^p = \frac{1}{\eta} < W_{mi}^p, E^i > \tag{9}$$

In the above, $\eta$ is the free space intrinsic impedance, m is a Fourier mode number, and the asterisk denotes complex conjugate.

For treatment of wave-guide cross-sections, a co-ordinate transformation is introduced to aid the application of the relationships used for rotationally symmetric objects. Under the transformation of co-ordinates, azimuthal Fourier modes are used to model the current along the wave-guide's cross-section. Since the transformation is in the x-y plane, a polar co-ordinate system can be used to relate the wave-guide cross-sectional contour to that of a cylindrical one in the transformed space. Thus, the elliptical horn's cross-section is viewed as a perturbation of a circle. The transformation introduces coupling of the azimuthal Fourier modes in the cross-section, and the resultant matrix equation does not reduce to individual modes, and includes all the current modes. However, the selected transformation has the property of increasing the density of matching points near the edges and results in a better sampling of the field singularity. As a result, one can limit the number of Fourier modes to a small number, but adequate for convergence of the solution. It should be mentioned that the current modes used here are similar to the eigen-functions of the cylindrical co-ordinate system. However, their excitation coefficients are geometry-dependent, i.e., cross-section aspect ratio, due to the transformation and influenced by the surface field intensity, polarization and angle of incidence. They should be distinguished from the actual or physical wave-guide modes.

In practice, the source of excitation is generally due to an aperture on the wave-guide wall, or a co-axial probe. Such an excitation is difficult to handle numerically. On the other hand, if the wave-guide dimensions are selected such that only the dominant mode can propagate, a simple dipole source can be used as the actual source of excitation. It has been used successfully in the past in studying the radiation patterns of corrugated circular horns by Iskander et al., (see K. A. Iskander, L. Shafai, A. Frandsen and J. Hansen, 'Application of impedance boundary conditions to numerical solution of corrugated circular horns', *IEEE Trans. Antenna Propag.*, AP-30, 366–372 (1982), incorporated herein by reference, hereinafter "Iskander et al."), and circular or co-axial wave-guides by Shafai and Kishk, (see L. Shafai and A. Kishk, 'Coaxial waveguides as primary feeds for reflector antennas and their comparison with circular waveguides', *AEU,* 39, 8–14 (1985), which is incorporated herein by reference). A similar source modeling is also adopted here. As a result, an x-directed electric dipole is located on the axis of symmetry at the point (0, 0, $Z_d$). Thus, the incident electric field may be written as, $$E^i = -j\omega A_d - \nabla\Phi_d \tag{10a}$$

Where, $A_d$ and $\Phi_d$ are the vector and scalar potentials given by, $$A_d = \frac{-jk\mu Idl}{4\pi} h_0^2(kr) \tag{10b}$$

$$\Phi_d = \frac{k}{4\pi\varepsilon\omega} Idl \cdot \nabla h_0^2(kr) \tag{10c}$$

Here, Idl is the dipole moment, $\epsilon$ and $\mu$ are the permittivity and permeability of the medium, respectively, k is a wave number, r is the distance between the source point and a field point, and $h^2_0$ (kr) is the spherical Hankel function of the second kind zero order defined as, $$h_0^2(kr) = \frac{e^{-jkr}}{kr} \tag{11}$$

Following the procedure of the moment method, the excitation vector ($V^p_{mi}$) can be transformed into an integral of the form, $$(V^t_{mi}) = \frac{-j\eta k|Idl|}{4\pi} \int_o^{\tau i} dt c f_i(t) \left[ \sin\beta G_1 + j \frac{\partial}{\partial t}(c f_i(t)) G_2 \right] \tag{12}$$

$$(V^s_{mi}) = \frac{j\eta k|Idl|}{4\pi} \int_o^{\tau i} dt c f_i(t) \left[ G_3 + \frac{jm}{c_i} c f_i(t) G_4 \right] \tag{13}$$

where, $$G_1 = \int_o^{2\pi} f(r, \xi) \cos\phi(\xi) d\xi \tag{13a}$$

$$G_2 = \int_o^{2\pi} f(r, \xi) \frac{1 + jkr}{kr} \frac{x}{r} d\xi \tag{13b}$$

$$G_3 = \int_o^{2\pi} f(r, \xi) \sin\alpha(\xi) d\xi \tag{13c}$$

$$G_4 = \int_o^{2\pi} L(\xi) \frac{1 + jkr}{kr} \frac{x}{r} d\xi \tag{13d}$$

with $$f(r, \xi) = h(\xi) \frac{e^{-jkr}}{kr} e^{-jm\xi} \tag{14a}$$

$$L(\xi) = \frac{1}{h(\xi)} [\sin\alpha x'_\xi + \cos\alpha y'_\xi] \tag{14c}$$

$$r = [p(\xi)^2 + (z - z_d)^2]^{\frac{1}{2}} \tag{14c}$$

Where, h(ξ) is the scaling factor of the transformed space, ξ is the polar angle defined from the x-axis in the new space, and $x'_\xi$, $y'_\xi$ are in turn the spatial derivatives of x(ξ) and y(ξ) with respect to ξ.

Using an approach similar to approximating the triangular basis functions by 2M pulses, (see Iskander et al.), the ith element of the excitation vectors can be written as, $$(V^t_{mi}) = \frac{-j\eta k|Idl|}{4\pi} \sum_{p=1}^{2M} [T_{p'} \sin\beta G_1 + T'_{p'} G_2] \tag{15a}$$

$$(V^s_{mi}) = \frac{j\eta k|Idl|}{4\pi} \sum_{p=1}^{2M} \left[ T_{p'} G_3 + \frac{jm}{kc_i} G_4 \right] \tag{15b}$$

Where $T_{p'}$ and $T'_{p'}$ denote the triangular basis functions and its derivatives. The current coefficients can be subsequently obtained by solving a system of linear equations of equation (8). Once the current coefficients are calculated, the radiation pattern of the wave-guide in both E- and H-planes can be determined by evaluating the total field, which is the sum of the incident field of the dipole located inside the wave-guide and the scattered field due to the induced surface currents. The radiation in the E- and H-planes can be subsequently determined by selecting the proper plane cuts, such as $\phi$=0° and $\phi$=90°, respectively.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A feed horn for use in at least one of transmitting and receiving circularly polarized signals in an antenna assembly that has a reflector with a non-circular profile, said feed horn comprising:

a body having a longitudinal axis extending between a proximal end for communication with the reflector and a distal end for communication with one of a transmitter and receiver;

a circular waveguide section located at said distal end of said body;

a corrugated waveguide section located at said proximal end of said body; and a conical waveguide section having a conically shaped, non-corrugated inner wall connected between said circular and corrugated waveguide sections, wherein said corrugated waveguide section comprises:

an inner wall that defines a circular cross-section at a distal end adjacent to said conical waveguide section, said inner wall incrementally widening to a non-circular cross-section at a proximal end of said corrugated waveguide section adjacent said proximal end of said body; and a plurality of grooves in said inner wall of said corrugated waveguide spaced along the longitudinal axis of said body, said grooves each having a depth defined in a thickness of said inner wall of said corrugation waveguide section, wherein said depth compensates circular polarized signals propagating through said body for distortions caused by the non-circular shape of the reflector.

2. A feed horn according to claim 1, wherein each of said grooves extend around the perimeter of the inner wall, such that each of said grooves defines respective propagation rings in said corrugated waveguide section having an outer perimeter that extends into the thickness of the inner wall by a defined depth for each groove and side walls extending from the outer perimeter to the inner wall of said corrugated waveguide section.

3. A feed horn according to claim 2, wherein said sidewalls of each of said grooves extends in a direction perpendicular the longitudinal axis of said body.

4. A feed horn according to claim 2, wherein the depth that each groove extends into the inner wall of said corrugated waveguide is defined by the cross-sectional shape of said propagation ring.

5. A feed horn according to claim 4, wherein a propagation ring defined by a groove adjacent to said distal end of said corrugated waveguide section has a cross-sectional shape that is more circular than a propagation ring defined by a groove adjacent to said proximal end of said corrugated waveguide section.

6. A feed horn according to claim 2, wherein the reflector of the antenna has an elliptical profile and said inner wall of said corrugated waveguide section defines a circular cross-section at a distal end adjacent to said conical waveguide section and incrementally widens to an elliptical cross-section at a proximal end of said corrugated waveguide section.

7. A feed horn according to claim 6, wherein each of said plurality of propagation rings defined by said grooves in said corrugated waveguide section have an elliptical cross-sectional shape, and wherein the cross-sectional shape of a propagation ring adjacent to said proximal end of said corrugated waveguide section has greater ellipticity than a propagation ring adjacent said distal end of said corrugated waveguide section.

8. A feed horn according to claim 7, wherein each of said plurality of propagation rings defined by said grooves in said corrugated waveguide section have an elliptical cross-sectional shape, and wherein the cross-sectional shape of a first propagation ring closer to said distal end of said corrugation waveguide section has a lesser elliptical shape than a second propagation ring that is located adjacent to a side of first propagation ring opposite the distal end of said corrugation waveguide, such that the corrugation rings transition from having a less elliptical shape adjacent to said distal end of said corrugated waveguide section to a greater elliptical shape adjacent to said proximal end of said corrugated waveguide section.

9. A feed horn according to claim 1, wherein the defined depth that each groove extends into said inner wall of said corrugated waveguide section is in a range between 0.25λ and 0.5λ.

10. A feed horn according to claim 1, wherein said conical waveguide section has an inner wall extending at an semiflare angle θ relative to said longitudinal axis of said body in a direction from the distal end of said conical waveguide section to the proximal end, wherein the semiflare angle θ is at least twenty degrees (20°).

11. A feed horn according to claim 1, wherein said conical waveguide section has a length extending in parallel with said longitudinal axis of 0.3λ.

12. A feed horn for use in at least one of transmitting and receiving circularly polarized signals in an antenna assembly that has a reflector with a non-circular profile, said feed horn comprising:

a corrugated waveguide section having:

an inner wall that defines a circular cross-section at a distal end, said inner wall incrementally widening to a non-circular cross-section along a longitudinal axis to a proximal end of said corrugated waveguide section; and a plurality of grooves in said inner wall of said corrugated waveguide section spaced along the longitudinal axis, said grooves each having a depth defined in a thickness of said inner wall of said corrugation waveguide section, wherein said depth compensates circular polarized signals propagating through said body for distortions caused by the non-circular shape of the reflector, and wherein one or more grooves have differing depth values.

13. A feed horn according to claim 12, wherein each of said grooves extend around the perimeter of the inner wall, such that each of said grooves defines respective propagation rings in said corrugated waveguide section having an outer perimeter that extends into the thickness of the inner wall by a defined depth for each groove and side walls extending from the outer perimeter to the inner wall of said corrugated waveguide section.

14. A feed horn according to claim 13, wherein said sidewalls of each of said grooves extends in a direction perpendicular the longitudinal axis.

15. A feed horn according to claim 13, wherein the depth that each groove extends into the inner wall of said corrugated waveguide is defined by the cross-sectional shape of said propagation ring.

16. A feed horn according to claim 15, wherein a propagation ring defined by a groove adjacent to said distal end of said corrugated waveguide section has a cross-sectional shape that is more circular than a propagation ring defined by a groove adjacent to said proximal end of said corrugated waveguide section.

17. A feed horn according to claim 13, wherein the reflector of the antenna has an elliptical profile and said inner wall of said corrugated waveguide section defines a circular cross-section at a distal end and incrementally widens to an elliptical cross-section at a proximal end of said corrugated waveguide section.

18. A feed horn according to claim 13, wherein the defined depth that each groove extends into said inner wall of said corrugated wave guide section is in a range between 0.25λ and 0.5λ.

19. An antenna assembly for transmitting and receiving circularly polarized signals comprising:

a reflector having a non-circular profile;

a communication assembly connected to a boom arm comprising a receiver and transmitter connected to an ortho-mode transducer; and a feed assembly connected to said communication assembly and positioned proximate to said reflector, said feed assembly comprising a corrugated waveguide section having an inner wall that defines a circular cross-section at a distal end, said inner wall incrementally widening to a non-circular cross-section along a longitudinal axis to a proximal end of said corrugated wave guide section, and a plurality of grooves in said inner wall of said corrugated waveguide section spaced along the longitudinal axis, said grooves each having a depth defined in a thickness of said inner wall of said corrugation waveguide section, wherein said depth compensates circular polarized signals propagating through said body for distortions caused by the non-circular shape of the reflector, and wherein one or more grooves have differing depth values.

20. An antenna assembly according to claim 19, wherein each of said grooves extend around the perimeter of the inner wall, such that each of said grooves defines respective propagation rings in said corrugated waveguide section having an outer perimeter that extends into the thickness of the inner wall by a defined depth for each groove and side walls extending from the outer perimeter to the inner wall of said corrugated waveguide section.

21. A feed horn according to claim 20, wherein said sidewalls of each of said grooves extends in a direction perpendicular the longitudinal axis of said body.

22. An antenna assembly for transmitting and receiving circularly polarized signals comprising:

a reflector having a non-circular profile;

a communication assembly connected to a boom arm comprising a receiver and transmitter connected to an otho-mode transducer;

a feed assembly connected to said communication assembly and positioned proximate to said reflector, said feed assembly comprising a corrugated waveguide section having an inner wall that defines a circular cross-section at a distal end, said inner wall incrementally widening to a non-circular cross-section along a longitudinal axis to a proximal end of said corrugated waveguide section, and a plurality of grooves in said inner wall of said corrugated waveguide section spaced along the longitudinal axis, said grooves each having a depth defined in a thickness of said inner wall of said corrugation waveguide section, wherein said depth compensates circular polarized signals propagating through said body for distortions caused by the non-circular shape of the reflector;

a circular waveguide section in communication with ortho-mode transducer; and a conical waveguide section having a conically shaped, non-corrugated inner wall connected between said circular and corrugated waveguide sections.

23. A feed horn for use in at least one of transmitting and receiving circularly polarized signals in an antenna assembly that has a reflector with a non-circular profile, said feed horn comprising:

a body having a longitudinal axis extending between a proximal end for communication with the reflector and a distal end for communication with one of a transmitter and receiver;

a circular waveguide section located at said distal end of said body;

a corrugated waveguide section located at said proximal end of said body; and a conical waveguide section having a conically shaped, non-corrugated inner wall connected between said circular and corrugated waveguide sections, wherein said corrugated waveguide section comprises:

an inner wall that defines a circular cross-section at a distal end adjacent to said conical waveguide section, said inner wall incrementally widening to a non-circular cross-section at a proximal end of said corrugated waveguide section adjacent said proximal end of said body.

24. A feed horn according to claim 23, wherein said conical waveguide section has an inner wall extending at an semiflare angle θ relative to said longitudinal axis of said body in a direction from the distal end of said conical waveguide section to the proximal end, wherein the semiflare angle θ is at least twenty degrees (20°).

25. A feed horn according to claim 23, wherein said conical waveguide section has a length extending in parallel with said longitudinal axis of 0.3λ.

26. A feed horn for use in at least one of transmitting and receiving circularly polarized signals in an antenna assembly that has a reflector with a non-circular profile, said feed horn comprising:

a corrugated waveguide section having:

an inner wall that defines a circular cross-section at a distal end, said inner wall incrementally widening to an elliptical cross-section along a longitudinal axis to a proximal end of said corrugated waveguide section, wherein for each increment said inner wall widens in both a major and minor axis of the elliptical cross-section such that both the major and minor axis of the elliptical cross-section is changed from that of the previous incremental cross-section; and a plurality of grooves in said inner wall of said corrugated waveguide section spaced along the longitudinal axis, said grooves each having a depth defined in a thickness of said inner wall of said corrugation waveguide section, wherein said depth compensates circular polarized signals propagating through said body for distortions caused by the non-circular shape of the reflector, and wherein one or more grooves have differing depth values.

27. An antenna assembly for transmitting and receiving circularly polarized signals comprising:

a reflector having a non-circular profile;

a communication assembly connected to a boom arm comprising a receiver and transmitter connected to an otho-mode transducer; and a feed assembly connected to said communication assembly and positioned proximate to said reflector, said feed assembly comprising a corrugated waveguide section having an inner wall that defines a circular cross-section at a distal end, said inner wall incrementally widening to an elliptical cross-section along a longitudinal axis to a proximal end of said corrugated waveguide section, wherein for each increment said inner wall widens in both a major and minor axis of the elliptical cross-section such that both the major and minor axis of the elliptical cross-section is changed from that of the previous incremental cross-section, and a plurality of grooves in said inner wall of said corrugated waveguide section spaced along the longitudinal axis, said grooves each having a depth defined in a thickness of said inner wall of said corrugation waveguide section, wherein said depth compensates circular polarized signals propagating through said body for distortions caused by the non-circular shape of the reflector, and wherein one or more grooves have differing depth values.

* * * * *